US005263527A

United States Patent [19]

Marlatt et al.

[11] Patent Number: 5,263,527

[45] Date of Patent: Nov. 23, 1993

[54] FIRE DOOR RELEASE MECHANISM

[75] Inventors: Wayne G. Marlatt, North Brunswick; Wojciech K. Cader, Edison, both of N.J.

[73] Assignee: Atlas Roll-Lite Door Corp., Orlando, Fla.

[21] Appl. No.: 967,754

[22] Filed: Oct. 28, 1992

[51] Int. Cl.[5] ..... E05F 15/20

[52] U.S. Cl. ..... 160/7; 160/310

[58] Field of Search ..... 160/7, 1, 9, 133, 310, 160/188, 311; 49/1, 5, 8

[56] References Cited

U.S. PATENT DOCUMENTS

| | | | |
|---|---|---|---|
| 1,709,271 | 4/1929 | McCloud et al. | 160/7 |
| 2,564,208 | 8/1951 | Michelman | 160/7 X |
| 3,559,716 | 2/1971 | Loucks | 160/9 |
| 3,613,765 | 10/1971 | Sivin | 160/1 |
| 4,147,197 | 4/1979 | Bailey et al. | 160/7 |
| 4,664,170 | 5/1987 | Labelle | 160/133 |
| 5,203,392 | 4/1993 | Shea | 160/7 |

*Primary Examiner*—David M. Purol

*Attorney, Agent, or Firm*—David L. Davis

[57] ABSTRACT

A fire door release mechanism includes a pair of levers engaging a bearing disc to hold a toothed clutch in engagement between a shaft of the fire door and a shaft of its operator. One of the levers has, at its end remote from the bearing disc, a pin on which a holding block is pivotally mounted. The other lever also has a pin at its remote end which is retained within a pocket on the holding block so long as tension is applied to the block, which tension is normally provided by a fuse link chain. When the tension is released, the levers, which are lightly spring biased, pivot out of engagement with the bearing disc to allow the clutch to disengage and separate the operator shaft from the fire door shaft.

19 Claims, 5 Drawing Sheets

FIRE DOOR RELEASE MECHANISM

BACKGROUND OF THE INVENTION

This invention relates to operator driven fire doors and, more particularly, to a release mechanism for uncoupling the operator from the door.

This invention is particularly concerned with rolling fire doors wherein, under normal conditions in the absence of a fire emergency, the door is coupled to an operator so that it can be selectively opened and closed during the course of a day. Some installations utilize a motor driven operator while other installations utilize a hand driven crank operator having internal gearing. Typically, the operator has an output shaft which is coupled to the rolling fire door shaft by a chain running over two sprocket wheels, each of which is associated with a respective one of the shafts. Alternatively, the operator shaft may be coupled to the door shaft by the direct engagement of gears. Upon the sensing of a fire condition, the door is typically uncoupled from the operator to allow it to close as urged by the force of gravity and the release of stored mechanical energy.

Three types of release mechanisms for such uncoupling are currently in widespread use. The first type is for use with the chain/sprocket wheel arrangement and comprises a finger release device wherein tension applied by a holding chain, conventionally having a fuse link along its length, is transferred to a pair of fingers which effect the meshing engagement of two sets of gear teeth. One of the sets of gear teeth is connected to one of the sprocket wheels and the other set of gear teeth is connected to the shaft associated with that sprocket wheel. Upon release of the tension by the chain, the fingers are allowed to drop so that the gear teeth disengage, thereby separating the sprocket wheel from its associated shaft and uncoupling the motor operator from the door. This arrangement has a number of disadvantages. For example, when the fingers drop they can cause damage by becoming entangled in the operator chain. Further, it is very difficult to set the fingers so that the gear teeth engage.

Another commonly used device for the chain/-sprocket wheel arrangement is known as a quartzoid release device which has a built in fusible pellet. Such a device is described in U.S. Pat. No. 3,613,765. This device also has the disadvantage that when the fusible pellet melts, its associated links drop away and can cause damage. Another disadvantage is the high cost of such a device. A still further disadvantage is that this device is only sensitive to fire in its immediate vicinity and cannot be triggered remotely.

When the shafts are coupled by the direct engagement of gears, release is effected by the use of drop-out arms which disengage the gears. Disadvantages of such an arrangement include the requirement that non-lubricated gears be used, as well as its relatively high cost.

It is therefore an object of the present invention to provide a fire door release mechanism which overcomes the disadvantages of the known prior art devices.

SUMMARY OF THE INVENTION

The foregoing and additional objects are attained in accordance with the principles of this invention by providing a fire door release mechanism which includes a pair of levers for engaging a bearing disc to hold a toothed clutch in engagement between the fire door and the operator. As described above, the operator is coupled to the fire door by a chain running over two sprocket wheels and the release mechanism is associated with one of the sprocket wheels. The levers of the release mechanism are each pivotably supported in central regions on a member coupled to the set of clutch teeth not associated with the sprocket wheel. One of the levers of the release mechanism has, at its end remote from the bearing disc, a pin on which a holding block is pivotably mounted. The other lever also has a pin at its remote end which is slipped into a pocket on the holding block, and the holding block is maintained in position by tension applied by a holding chain. In the event of a fire, release of the tension applied by the holding chain allows the holding block to release the levers, which are lightly spring biased. Upon being released, the levers pivot away from the bearing disc to allow the clutch teeth to disengage and uncouple the operator from the door

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 5 is a side view of the release mechanism according to this invention shown with its teeth disengaged;

DETAILED DESCRIPTION

Figure 1:
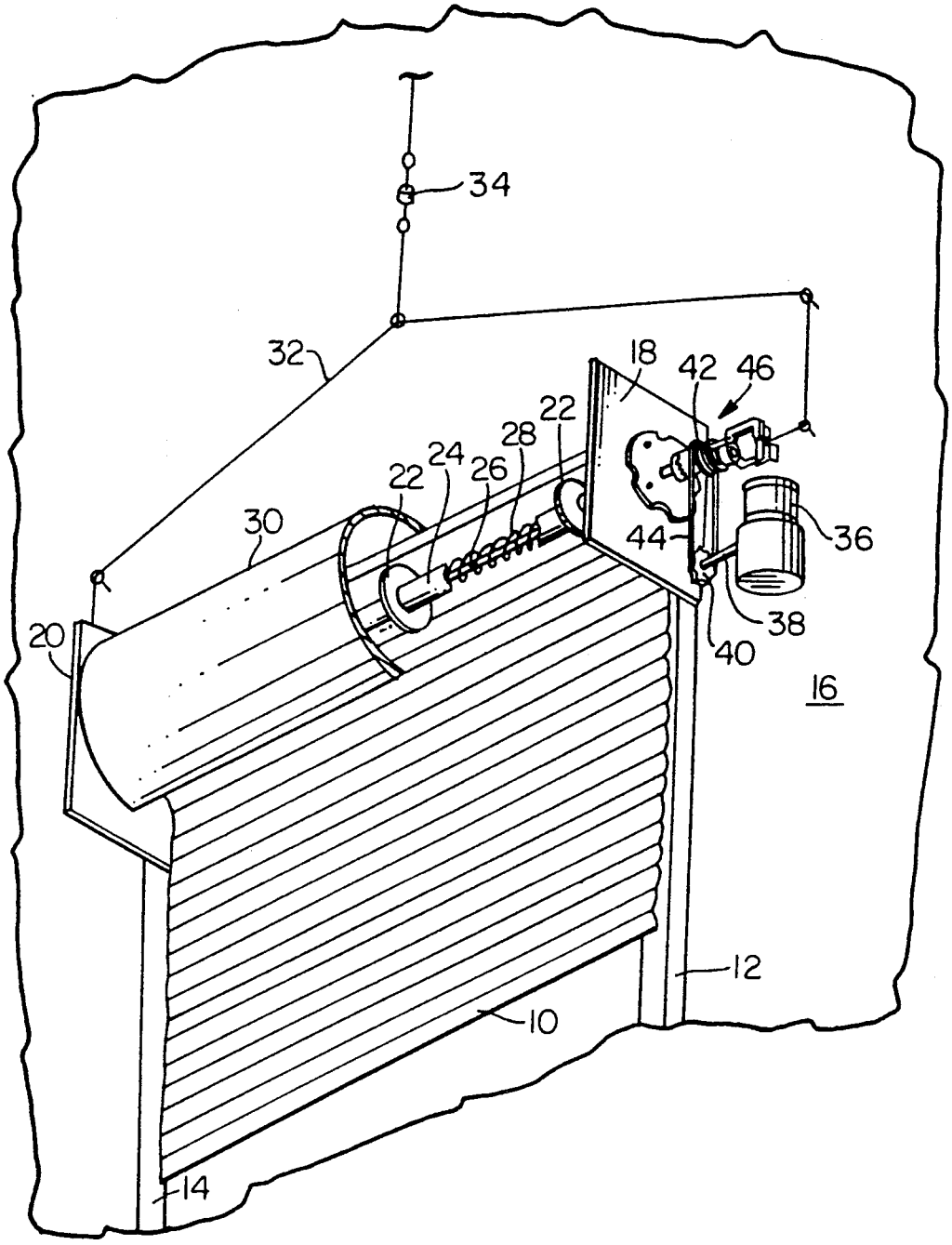
FIG. 1 is a perspective view, partially broken away, showing a rolling fire door controlled by a motor operator, with the coupling between the motor operator and the fire door being effected by a release mechanism according to this invention.

FIG. 1 shows a prior art rolling fire door of the type manufactured and sold by Atlas Roll-Lite Door Corporation of Edison, N.J., with which the present invention finds utility. As shown in FIG. 1, the fire door 10 is guided by the vertical guide angles 12 and 14 which flank an opening selectively covered by the fire door 10. The guide angles 12, 14 are bolted to the wall 16 and have attached at their upper ends the bracket plates 18 and 20, respectively.

The door 10, which is comprised of a plurality of interlocked horizontal segments, is attached at its upper end to a plurality of rings 22 which are mounted to the hollow pipe shaft 24. By rotating the pipe shaft 24, the door 10 may be selectively raised or lowered. Within the pipe shaft 24, is a relatively long inner rod (not shown) extending through the plate 20 and pinned at one end to an adjusting wheel (not shown) rotatably mounted to the bracket plate 20. Also within the pipe shaft 24 is a relatively short inner rod 26 fixedly secured to the pipe shaft 24. A helical tension spring 28 surrounding the rod 26 has one end connected to the long inner rod and its other connected to the outer pipe shaft 24. This assembly is preferably hidden from view by a cover 30 which extends between the bracket plates 18 and 20.

As is well known in the art, the spring 28 is utilized to store mechanical energy to assist in closing the door 10. Specifically, when the door 10 is in its fully open (raised) position, the spring 28 is placed under tension by turning the adjusting wheel. The adjusting wheel is kept from moving in a known manner by a holding bar adapted to engage notches in the periphery of the adjusting wheel. The holding bar is held in position by the holding chain, or cable, 32, which is normally under tension. If, however, the chain 32 is released, due to melting of the fusible link 34, the holding bar is allowed to disengage from the adjusting wheel. The tension in the spring 28 then causes the adjusting wheel and the short inner rod to spin. A kicker mechanism (not shown) between the long inner rod and the pipe shaft 24 imparts energy to the pipe shaft 24 which starts the door 10 closing, which closing is aided by gravity.

Although the drawings show a fusible link 34 for releasing the holding chain 32, it is understood that other arrangements for releasing the holding chain 32 may also be utilized. For example, an electro-mechanical release device such as the Fire Scout TM manufactured and sold by Atlas Roll-Lite Door Corporation of Edison, N.J., may be installed to selectively hold the chain 32 under tension until a fire is detected.

The present invention is designed for use when the fire door 10 is coupled to a door operator. For illustrative purposes, a motor driven operator is disclosed, but it is understood that other operators may also be utilized. Such an operator is shown mounted to the bracket plate 18. Illustratively, the operator includes a motor 36 and has an output shaft 38. The shaft 38 has secured thereto a sprocket wheel 40 which is coupled to a sprocket wheel 42 by means of a chain 44 which runs over the two sprocket wheels 40 and 42. The sprocket wheel 42 is operatively coupled to the pipe shaft 24 by the release mechanism 46 according to this invention. Thus, the operator shaft 38 is normally coupled to the pipe shaft 24 so that during the normal course of the day the door 10 may be selectively raised and lowered under operator control. However, in the event of a fire where the door 10 has to be lowered by gravity and assistance from the spring 28, the pipe shaft 24 must be separated from the operator shaft 38 to allow the door 10 freedom to close. According to this invention, the release mechanism 46 is coupled to the chain 32 so that when tension is applied to the chain 32, the release mechanism 46 is operative to couple the sprocket wheel 42 to the pipe shaft 24, but when tension is released from the chain 32 due to melting of the fusible link 34, the pipe shaft 24 is uncoupled from the sprocket wheel 42.

Figure 2:
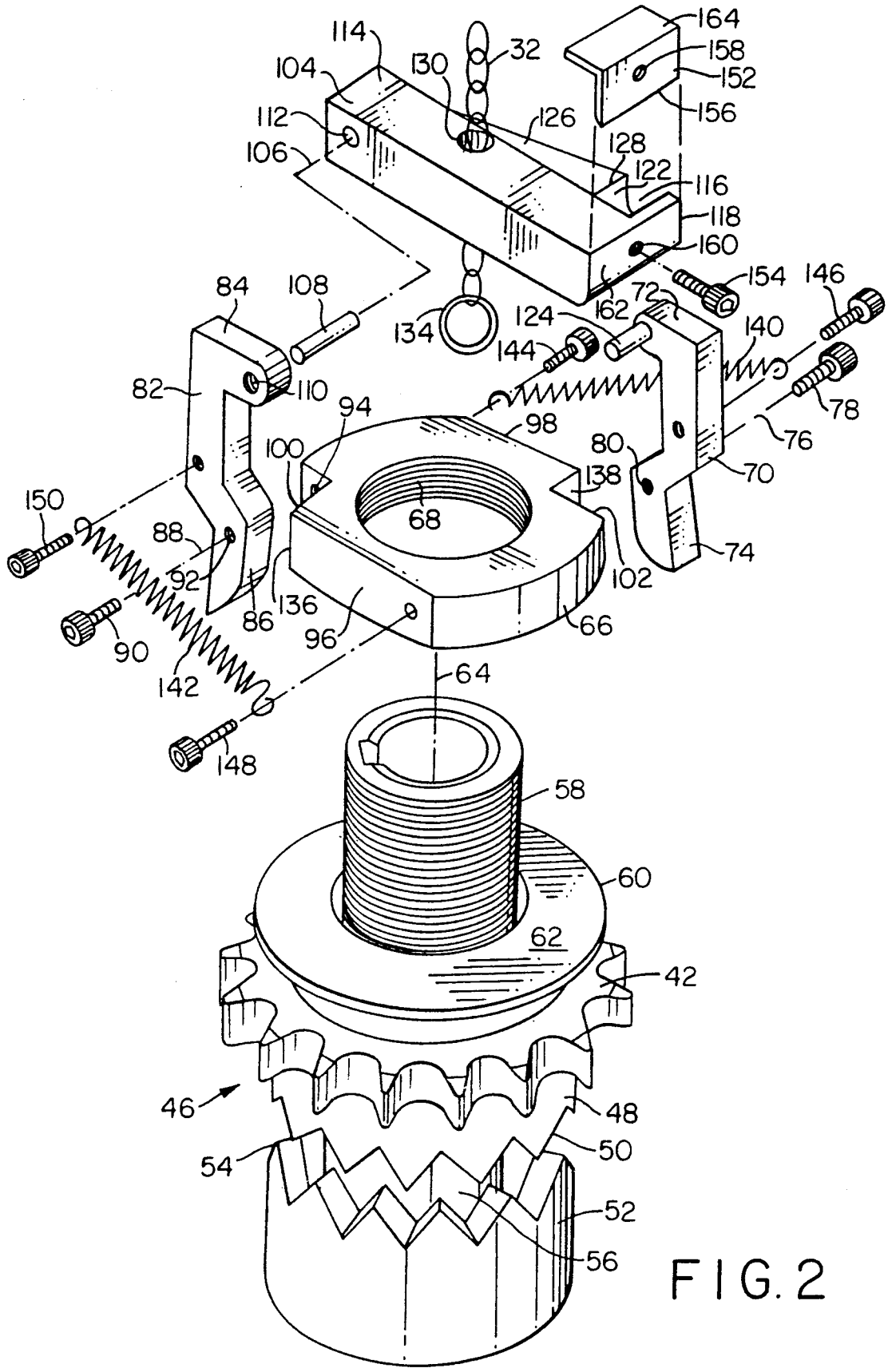
FIG. 2 is an exploded perspective view of a release mechanism constructed according to the principles of this invention.

Referring to FIG. 2, the release mechanism 46 according to the present invention includes a first bushing 48 which is coaxially secured to the sprocket wheel 42. The bushing 48 is formed with gear teeth 50 at its end remote from the sprocket wheel 42. The securing of the bushing 48 to the sprocket wheel 42 is such that they move together with each other. Preferably, the teeth 50 form a crown gear. The release mechanism 46 further includes a second bushing 52 which is coaxially secured to the pipe shaft 24 (FIG. 1) for rotation therewith. Such securement may be effected in any known manner such as, for example, by providing a keyed slot arrangement. The bushing 52 is formed with gear teeth 54, which preferably form a crown gear adapted for meshing engagement with the gear teeth 50. The bushing 52 is further formed with a central stub 56 which extends coaxially through the bushing 48 and the sprocket wheel 42. At its end remote from the gear teeth 54, the central stub 56 is formed with external threads 58.

The mechanism 46 further includes a bearing disc 60 which is coaxially secured to the sprocket wheel 42 on the side of the sprocket wheel 42 which is remote from the gear teeth 50. The bearing disc 60 has a planar bearing surface 6 which is remote from the sprocket wheel 42 and lies in a plane which is orthogonal to the axis 64 of the central stub 56. The axis 64 of the central stub 56 is also the axis of the bearing disc 60, the sprocket wheel 42 and the bushing 48. The bearing disc 60, the sprocket wheel 42 and the bushing 48 are secured to each other in such a manner that they are freely slidable and rotatable in unison on the central stub 56 when the gear teeth 50, 54 are disengaged.

Threadedly secured to the central stub 56 is an adjusting ring 66, having internal threads 68. The adjusting ring 66 is mounted to the central stub 56 beyond the bearing disc 60 from the gear teeth 54 and its axial position on the central stub 56 may be adjusted by turning the adjusting ring 66 on the threads 58. When the proper position is attained, as will be described hereinafter, a set screw (not shown) extending through the adjusting ring 66 is tightened.

A slide lever 70 having a first end 72 and a second end 74 is pivotally mounted to the adjusting ring 66 about a pivot axis 76 which is between the first and second ends 72, 74, and which is spaced from and orthogonal to the central stub axis 64. Such mounting is illustratively by means of a screw member 78 which extends through a bore 80 in the slide lever 70 and is secured in an appropriately threaded hole (not shown) in the adjusting ring 66.

Similarly, a link lever 82 having a first end 84 and a second end 86 is pivotally mounted to the adjusting ring 66 about a pivot axis 88. Such mounting is illustratively effected by means of a screw member 90 which extends through a bore 92 in the link lever 82 and is secured in a threaded hole 94 provided in the adjusting ring 66. The link lever pivot axis 88 is parallel to the slide lever pivot axis 76 and is on the other side of the central stub axis 64 from the slide lever pivot axis 76.

The adjusting ring 66 has its periphery formed with parallel flats 96 and 98, the diametrically opposed ends of which are notched at 100 and 102, respectively. The flats 96, 98 and the notches 100, 102 are for appropriate mounting and limiting the rotation of the levers 70, 82, as will be described in more detail hereinafter.

According to this invention, the release mechanism 46 also includes a holding block 104, which is preferably generally rectilinear in configuration. The holding block 104 is pivotally mounted to the link lever first end about a pivot axis 106 which is parallel to the link lever pivot axis 88. Such mounting is preferably effected by a pin, or dowel, 108 which extends into a bore 110 in the link lever 82 and a bore 112 in the holding block 104. The holding block 104 is preferably generally rectilinear with planar exterior surfaces, including a first surface 114. A pocket 116 extends into the holding block 104 from the first surface 114, which pocket 116 is also open along a second surface 118 of the holding block 104. The pocket 116 is remote from the holding block pivot axis 106 and is generally U-shaped in a plane orthogonal to the pivot axis 106 when viewed toward the second surface 118, as is best seen in FIG. 5. Specifically, the pocket 116 is formed with a first wall 120 extending into the pocket 116 from the surface 114. The wall 120 is parallel to the pivot axis 106, is generally parallel to the central stub axis 64, and is on the side of the pocket 116 which is remote from the holding block pivot axis 106. The pocket 116 is further formed with a second wall 122 which extends into the pocket from the surface 114. The second wall 122 is parallel to the holding block pivot axis 106 and is slanted with respect to the wall 120 so that the pocket 116 is widest at its opening to the surface 114 in the plane which is orthogonal to the holding block pivot axis 106 when viewed toward the second surface 118, as is best seen in FIG. 5.

Figure 3:
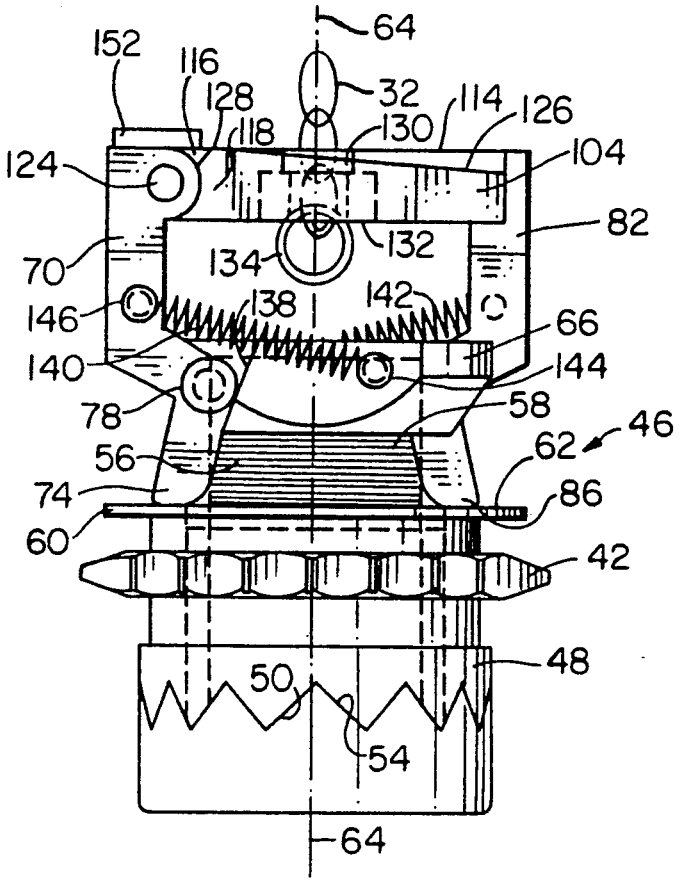
FIG. 3 is a side view of the release mechanism according to this invention shown with its teeth engaged.
Figure 4:
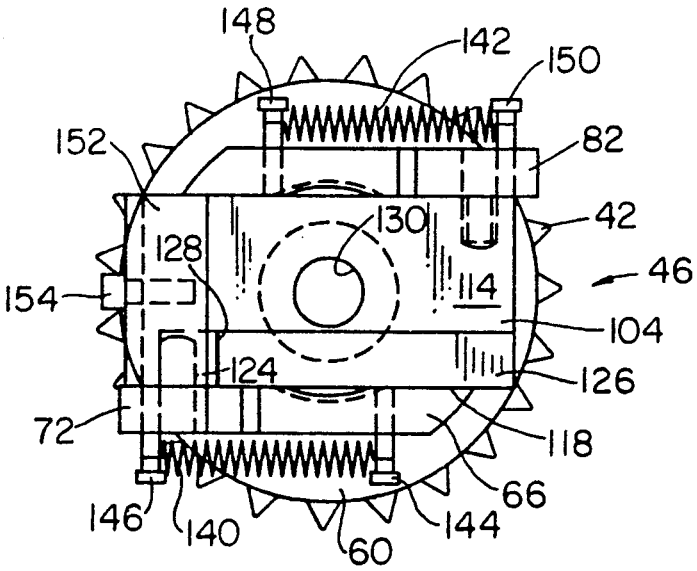
FIG. 4 is an end view of the release mechanism shown in FIG. 3.

To cooperate with the pocket 116, there is provided a pin member 124 which is secured to the slide lever 70 at its first end 72. The longitudinal axis of the pin member 124 is parallel to the slide lever pivot axis 76. The pin member 124 is adapted to extend into the pocket 116 from its open side along the surface 118 of the holding block 104. To assist in inserting the pin member 124 into the pocket 116, the holding block 104 is formed with a planar ramp 126 which is parallel to the holding block pivot axis 106. The ramp 126 extends from the juncture 128 of the surface 114 and the pocket wall 122 toward and beyond the holding block pivot axis 106 to the remote end of the holding block 104. As best seen in FIG. 3, the ramp 126 is slanted with respect to a plane orthogonal to the central stub axis 64. As best seen in FIG. 4, the ramp 126 has a width extending from the holding block second surface 118 which is sufficient to accommodate the length of the pin member 124 along its longitudinal axis. preferably, the width of the ramp 126 and the depth of the pocket 116 from the holding second surface 118 are equal.

When tension is applied to the holding block 104 with the pin member 124 within the pocket 116, the slide lever 70 and the link lever 82 are pivoted so that their second ends 74, 86, respectively, engage the bearing surface 62 of the bearing disc 60, as best shown in FIG. 3. When this is the case, the pin member 124 is retained within the pocket 116, the pocket 116 being on the opposite side of the central stub axis 64 from the holding block pivot axis 106. Engagement of the ends 74, 86 of the levers 70, 82 against the bearing surface 62 of the bearing disc 60 maintains the sets of gear teeth 50, 54 in meshing engagement, so that the sprocket wheel 42 is operatively coupled to the pipe shaft 24. The tension which maintains this condition is applied by the chain 32. To connect the chain 32 to the holding block 104, the holding block 104 is formed with a through bore 130 having an axis which is orthogonal to the holding block surface 114 as well as being orthogonal to the holding block pivot axis 106. When the pin member 124 is retained in the pocket 116, the bore 130 is coaxial with the central stub axis 64. In a first embodiment, the diameter of the bore 130 is sized to allow the chain 32 to freely pass therethrough and the end of the bore 130 remote from the surface 114 is enlarged to hold a bearing 132 therein. After the chain 32 is inserted through the bore 130, an enlarged ring 134 is attached at the end of the chain 32. The ring 134 is larger than the bore 130 so it cannot pass therethrough, and it rides on the bearing 132 so that the holding block 104 can freely rotate relative to the chain 32 about the axis 64.

Figure 7:
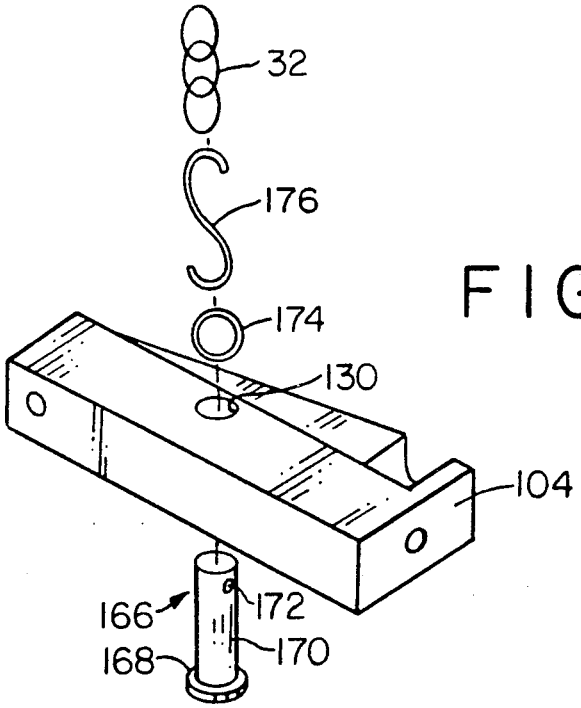
FIG. 7 illustrates an alternative arrangement for coupling the holding chain to the holding block.
Figure 6:
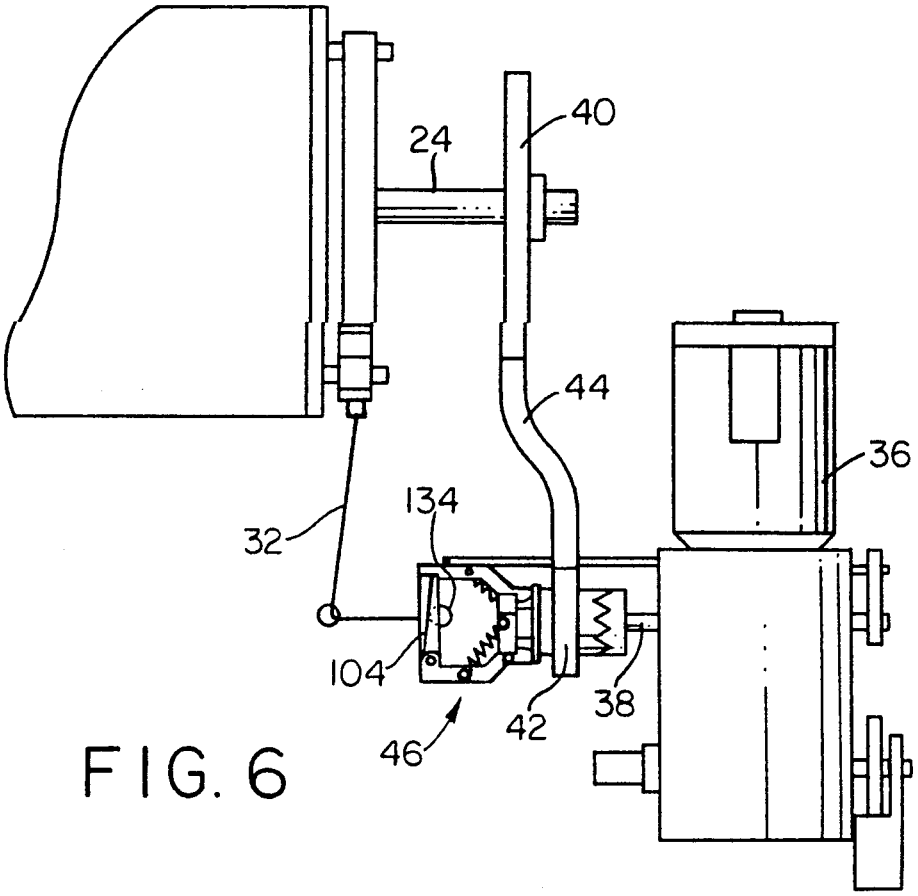
Figure 7:
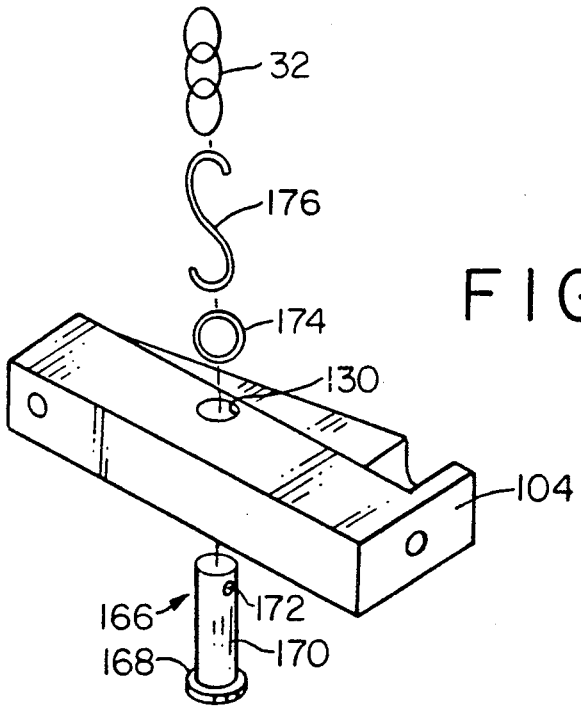

A second embodiment of an arrangement for coupling the chain 32 to the holding block 104 is shown in FIG. 7. In this embodiment, there is provided a pin 166 having a head portion 168 at one end thereof. The elongated body portion 170 of the pin 166 is sized to fit with clearance within the bore 130 of the holding block 104, whereas the head portion 168 is enlarged so as to be constrained to ride on the bearing 132 (not shown in FIG. 7). At the end of the body portion 170 remote from the head portion 168, the pin 166 is formed with a transverse through bore 172. The distance between the head portion 168 and the bore 172 is greater than the thickness of the holding block 104 so that when the head portion 168 rides against the bearing 132, the bore 172 is accessible from the other side of the holding block 104. A ring 174 is inserted through the bore 172 after the pin 166 is inserted through the bore 130 of the holding block 104. To attach the chain 32, there is provided an S-hook 176, one end of which is inserted through the ring 174 and the other end of which is inserted through the last link of the chain 32. With this arrangement, free rotation of the holding block 104 relative to the chain 32 about the axis 64 (not shown in FIG. 7) is attained.

When the application of tension is discontinued by the chain 32, the release mechanism 46 is designed so that the pin member 124 emerges from the pocket 116 and the levers 70, 82 separate at their second ends 74, 86 so that they no longer engage the bearing surface 62 of the bearing disc 60 and allow disengagement of the gear teeth 50, 54 to uncouple the sprocket wheel 42 from the pipe shaft 24, as is best illustrated in FIG. 5. Toward that end, the ends 74, 86 of the levers 70, 82 are each formed as a cylindrical segment. In addition, the notches 100, 102 are formed with respective walls 136, 138 which form stops to limit the rotation of the levers 70, 82. These stops are such that if one were to draw planes passing through the axes 76, 88 of the levers 70, 82 and orthogonal to the bearing surface 62, the points of engagement of the second ends 74, 86 of the levers 70, 82 would be on the other side of the axis 64 from those planes. This geometry allows the levers 70, 82 to pivot and disengage from the bearing disc 60 when the tension applied by the chain 32 is released. To assist in such disengagement, there are provided springs 140, 142 associated with each of the levers 70, 82, respectively. Thus, the spring 140 is coupled to the adjusting ring 66 by the screw member 144 and to the link lever 70 by the screw member 146 at a location on the link lever between the pivot axis 76 and the first end 72. Similarly, the spring 142 is coupled to the adjusting ring 66 by the screw member 148 and to the link lever 82 by the screw member 150 at a location on the link lever 82 between the pivot axis 88 and the first end 84. Thus, the spring 140 operates to lightly bias the slide lever 70 about its pivot axis 76 in a direction to urge the pin member 124 along the pocket wall 128 and out of the pocket 116, while at the same time, the spring 142 operates to lightly bias the link lever 82 about the pivot axis 88 in a direction to urge the holding block 104 toward the adjusting ring 66.

In summary, when the holding chain 32 discontinues the application of tension, the adjusting wheel mechanism on the bracket plate 20 is released at the same time that the holding block 104 is released. Release of the holding block 104 removes pressure from the bearing disc 60, as discussed above. Release of the adjusting wheel mechanism on the bracket plate 20 causes the pipe shaft 24 to start rotating. Due to the angles of the gear teeth 50, 54, rotation of the pipe shaft 24 without pressure being applied to the bearing disc 60 causes the gear teeth 50, 54 to disengage so that the release mechanism 46 attains the state shown in FIG. 5.

For shipping and installation purposes, the release mechanism 46 is provided with a retainer to keep the pin member 124 within the pocket 116 irrespective of the application of a tension force to the holding block 104. This retainer includes a generally L-shaped bracket 152 and a screw member 154. The bracket 152 has a first leg 156 with a through bore 158 and the screw member 154 is adapted to extend through the bore 158 and be threadedly secured in a threaded bore 160 extending into the holding block 104 from the surface 162 which is adjacent to both the surfaces 114 and 118. When the bracket 152 is so secured to the holding block 104, its other leg 164 overlies the pocket 116. Preferably, the leg 164 engages the surface 114. Thus, for shipment and installation, the levers 70, 82 are pivoted against the biasing forces of the springs 140, 142 so that the pin member 124 rides up the ramp 126 and enters the pocket 116. The bracket 152 is then installed to retain the pin member 124 within the pocket 116. The adjusting ring 66 is then turned on the central stub 56 until the second ends 74, 86 of the levers 70, 82 just touch the bearing surface 62. The adjusting ring 66 is then turned in the reverse direction approximately ⅛ of a turn so that there is a slight clearance between the second ends 74, 86 of the levers 70, 82 and the bearing surface 62. The set screw on the adjusting ring 6 is then tightened to prevent the adjusting ring 66 from turning once it is set. After the release mechanism 46 is installed with the chain 32 and the ring member 134 in place so that a tension force is applied to the holding block 104 in a direction away from the adjusting ring 66, the bracket 152 is removed. Upon release of tension by the chain 32, the springs 140, 142 will cause the levers 70 and 82 to spread, as best shown in FIG. 5, to allow the gear teeth 50, 54 to disengage. With the teeth 50, 54 disengaged, the sprocket wheel 42, which is secured to the bushing 48, is uncoupled from the pipe shaft 24, which is secured to the bushing 52.

Figure 6:
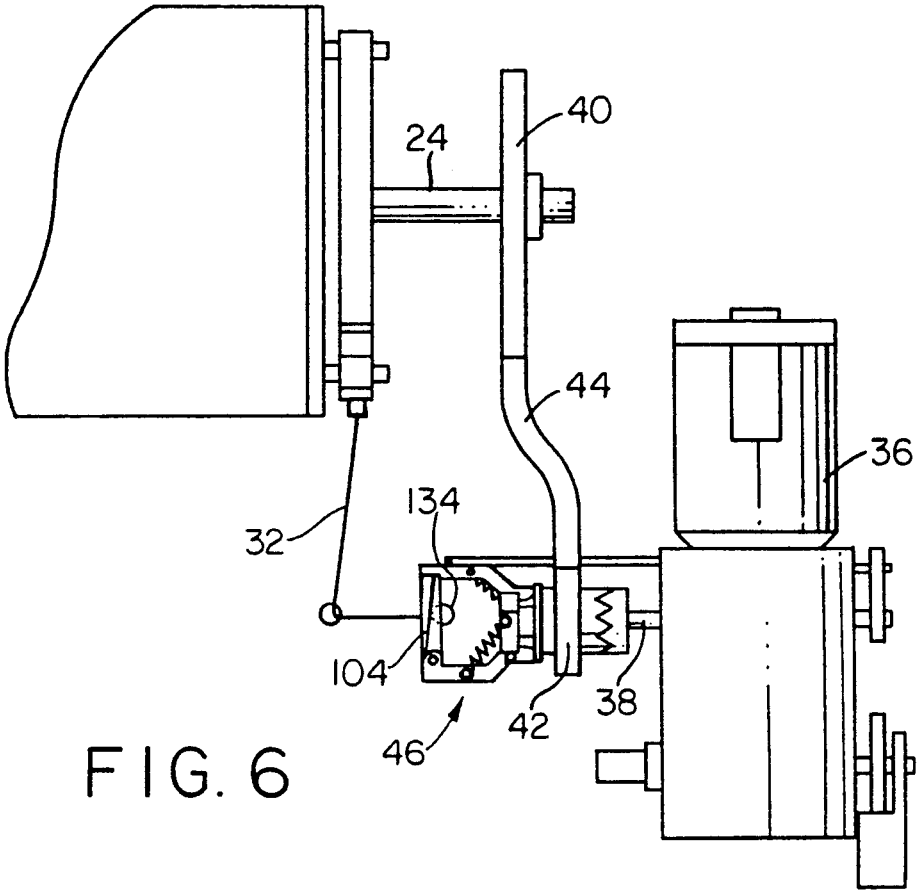
FIG. 6 schematically depicts a preferred placement for the inventive release mechanism different from the placement shown in FIG. 1.

FIG. 6 schematically depicts a preferred placement for the release mechanism 46. As shown in FIG. 6, the release mechanism 46 is preferably associated with the operator output shaft 38 instead of with the pipe shaft 24. In all other respects, the operation remains the same so that actuation of the release mechanism 46 will cause an uncoupling of the sprocket wheel 42 from the operator output shaft 38, thereby uncoupling the operator from the door. It is noted that the sprocket wheels 40, 42 are offset in their axial directions. This is to aid in the separation of the gear teeth 50, 54. Such an offset also occurs in the placement of the release mechanism 46 as shown in FIG. 1.

Accordingly, there has been disclosed an improved release mechanism for uncoupling an operator from a fire door. While a preferred embodiment of the present invention has been disclosed herein, it is understood that various modifications and adaptations to the disclosed embodiment will be apparent to those of ordinary skill in the art and it is only intended that this invention be limited by the scope of the appended claims.

We claim:

1. In combination with a rolling fire door secured to a first shaft, rotation of the first shaft effecting movement of the door between open and closed positions, and an operator for selectively moving said door, the operator having a second shaft coupled to said first shaft by a chain running over two sprocket wheels, each of the sprocket wheels being associated with a respective one of said first and second shafts, a release mechanism operatively coupled to one of said sprocket wheels and one of said shafts for selectively uncoupling said second shaft from said first shaft comprising:

a first bushing coaxially secured to said one sprocket wheel for rotation therewith, said first bushing being formed with first gear teeth at its end remote from said one sprocket wheel;

a second bushing coaxially secured to said one shaft for rotation therewith, said second bushing being formed with second gear teeth adapted for meshing engagement with said first gear teeth, said second bushing being further formed with a central stub extending coaxially through said first bushing and said one sprocket wheel;

a bearing disc coaxially secured to said one sprocket wheel on the side of said one sprocket wheel which is remote from said first bushing first gear teeth, said bearing disc having a planar bearing surface remote from said one sprocket wheel and orthogonal to the axis of said central stub, and wherein said one sprocket wheel, said first bushing and said bearing disc are arranged to be freely slidable and rotatable in unison on said central stub when said first and second gear teeth are disengaged;

an adjusting ring secured to said central stub remote from said second gear teeth and beyond said bearing disc;

a slide lever having a first end and a second end;

a link lever having a first end and a second end;

means for pivotally mounting said slide lever to said adjusting ring about a pivot axis between said slide lever first and second ends, said slide lever pivot axis being spaced from and orthogonal to said central stub axis;

means for pivotally mounting said link lever to said adjusting ring about a pivot axis between said link lever first and second ends, said link lever pivot axis being parallel to said slide lever pivot axis and on the other side of said central stub axis from said slide lever pivot axis;

a holding block pivotally mounted to said link lever first end about a pivot axis parallel to said link lever pivot axis, said holding block having a first surface remote from said bearing disc, said holding block being formed with a pocket extending into said holding block from said first surface and also open along a second surface of said holding block at a location which is remote from said holding block pivot axis, said pocket being generally U-shaped in a plane orthogonal to said holding block pivot axis when viewed toward said second surface;

a pin member secured to said slide lever first end and adapted for containment within said holding block pocket, said pin member having a longitudinal axis parallel to said slide lever pivot axis and extending into said holding block pocket from said holding block second surface; and tension means for releasably applying a force to said holding block along said central stub axis in a direction away from said adjusting ring so as to releasably retain said pin member in said holding block pocket, said holding block pocket being on the opposite side of said central stub axis from said holding block pivot axis when said tension means applies said force and said pin member is within said pocket;

wherein when said pin member is retained within said holding block pocket by the application of said force to said holding block, said link lever and said slide lever are pivotally positioned so that their second ends engage said bearing surface of said bearing disc to maintain said first and second gear teeth in meshing engagement, and when said tension means discontinues applying said force to said holding block so that said pin member emerges from said holding block pocket, said link lever and said slide lever are free to pivot so that their second ends disengage from said bearing surface of said bearing disc to allow disengagement of said first and second gear teeth.

2. The release mechanism according to claim 1 wherein said holding block pocket is formed with:

a first wall extending into said pocket from said first surface, said first wall being parallel to said holding block pivot axis, generally parallel to said central stub axis, and on the side of said pocket remote from said holding block pivot axis; and a second wall across said pocket from said first wall and extending into said pocket from said first surface, said second wall being parallel to said holding block pivot axis and slanted with respect to said first wall so that said pocket is widest at its opening to said first surface in said plane orthogonal to said holding block pivot axis when viewed toward said second surface.

3. The release mechanism according to claim 2 wherein said holding block is formed with a planar ramp which is parallel to said holding block pivot axis and extends from the juncture of said first surface with said pocket second wall toward and beyond said holding block pivot axis to an end of said holding block, said ramp being slanted with respect to a plane orthogonal to said central stub axis, said ramp having a width extending from said holding block second surface which is sufficient to accommodate the length of said pin member along its longitudinal axis.

4. The release mechanism according to claim 2 further including:

first bias means for yieldably biasing said slide lever about said slide lever pivot axis in a direction to urge said pin member along said pocket second wall and out of said pocket; and second bias means for yieldably biasing said link lever about said link lever pivot axis in a direction to urge said holding block toward said adjusting ring.

5. The release mechanism according to claim 4 wherein:

said first bias means includes a first spring coupled between said adjusting ring and said slide lever at a location on said slide lever between said slide lever pivot axis and said slide lever first end; and said second bias means includes a second spring coupled between said adjusting ring and said link lever at a location on said link lever between said link lever pivot axis and said link lever first end.

6. The release mechanism according to claim 4 wherein the second ends of said slide lever and said link lever are each formed as a cylindrical segment and further including:

first stop means for preventing said slide lever from moving about said slide lever pivot axis beyond a first predetermined limit in a direction opposite the direction urged by said first bias means; and second stop means for preventing said link lever from moving about said link lever pivot axis beyond a second predetermined limit in a direction opposite the direction urged by said second bias means;

said first predetermined limit being such that the point of engagement of said slide lever second end with said bearing surface is on the other side of said central stub axis from a first plane passing through said slide lever pivot axis and orthogonal to said bearing surface;

said second predetermined limit being such that the point of engagement of said link lever second end with said bearing surface is on the other side of said central stub axis from a second plane passing through said link lever pivot axis and orthogonal to said bearing surface;

7. The release mechanism according to claim 1 wherein the second ends of said slide lever and said link lever are each formed as a cylindrical segment.

8. The release mechanism according to claim 1 further including means for selectively setting the distance between said adjusting ring and said bearing disc.

9. The release mechanism according to claim 8 wherein said distance setting means includes external threads on said central stub and internal threads on said adjusting ring.

10. The release mechanism according to claim 1 wherein said tension means includes a chain.

11. The release mechanism according to claim 10 wherein said holding block is formed with a through bore having an axis which is transverse to said holding block first surface and orthogonal to said holding block pivot axis, said chain extends through said bore, and said bore is coaxial with said central stub axis when said pin member is retained in said holding block pocket.

12. The release mechanism according to claim 11 further including a bearing supported in said holding block bore, said chain being terminated with a member of larger dimension than said bore which rides on said bearing so that said holding block can freely rotate relative to said chain about said central stub axis.

13. The release mechanism according to claim 12 wherein said member of larger dimension includes a ring attached to a link of said chain.

14. The release mechanism according to claim 10 wherein said chain has a fuselink.

15. The release mechanism according to claim 10 wherein said holding block is formed with a through bore having an axis which is transverse to said holding block first surface and orthogonal to said holding block pivot axis, said bore being coaxial with said central stub axis when said pin member is retained in said holding block pocket, and further including:

a second pin member having an enlarged head at one end and a transverse through bore remote from said head, the distance between said head and said transverse through bore being greater than the length of said holding block through bore along the axis of said holding block through bore; and means for coupling said chain to said second pin member bore.

16. The release mechanism according to claim 15 wherein said coupling means includes a ring attached to said second pin member bore and an S-hook attached at one end to said ring and at a second end to said chain.

17. The release mechanism according to claim 1 further including means for retaining said pin member in said holding block pocket irrespective of the application of said force by said tension means.

18. The release mechanism according to claim 17 wherein said retaining means includes a generally L-shaped bracket adapted to have a first leg secured to a surface of said holding block with the other leg engaging said first surface and covering said pocket.

19. The release mechanism according to claim 1 where in said holding block is generally rectilinear with planar exterior surfaces.

* * * * *